US009343856B2

(12) United States Patent
Zwartkruis et al.

(10) Patent No.: US 9,343,856 B2
(45) Date of Patent: May 17, 2016

(54) ELECTRICAL CONNECTOR HAVING A SPRING WITH PARALLEL LEGS WITH BIASED MID-SECTIONS

(71) Applicant: TE Connectivity Nederland BV, AR s'Hertogenbosch (NL)

(72) Inventors: Sjoerd Zwartkruis, CB Grave (NL); Tim Valkenburg, LT Herten (NL); Jacobus Nicolaas Tuin, HC Best (NL); Martijn Riemeijer, LL's-Hertogenbosch (NL)

(73) Assignee: TE Connectivity Nederland BV, S-Hertogenbosch (NL)

( * ) Notice: Subject to any disclaimer, the term of this patent is extended or adjusted under 35 U.S.C. 154(b) by 0 days.

(21) Appl. No.: 14/541,288

(22) Filed: Nov. 14, 2014

(65) Prior Publication Data

US 2015/0155663 A1 Jun. 4, 2015

Related U.S. Application Data

(63) Continuation of application No. PCT/EP2013/001442, filed on May 15, 2013.

(30) Foreign Application Priority Data

May 16, 2012 (EP) ..... 12003881

(51) Int. Cl.
*H01R 29/00* (2006.01)
*H01R 24/58* (2011.01)
(Continued)

(52) U.S. Cl.
CPC ..... *H01R 24/58* (2013.01); *H01R 13/5202* (2013.01); *H01R 13/6277* (2013.01); *H01R 13/639* (2013.01); *H01R 13/6581* (2013.01);
(Continued)

(58) Field of Classification Search
CPC .. H01R 13/70; H01R 113/701; H01R 13/703; H01R 13/7032
USPC ..... 439/188, 688, 668
See application file for complete search history.

(56) References Cited

U.S. PATENT DOCUMENTS 3,171,887 A * 3/1965 Cross ..... H01R 13/5202 174/355
3,514,737 A 5/1970 Renshaw, Jr.
(Continued)

FOREIGN PATENT DOCUMENTS

CN 2831493 Y 10/2006
JP 2001217053 8/2001

OTHER PUBLICATIONS

PCT International Search Report issued in co-pending International Applicatoin No. PCT/EP2013/001442, dated Aug. 9, 2013, 16 pages.
(Continued)

*Primary Examiner* — Chandrika Prasad
(74) *Attorney, Agent, or Firm* — Barley Snyder

(57) ABSTRACT

An electrical connector is provided and includes an insulating housing, a contact, and a metal spring. The insulating housing includes a body with a substantially planar lower wall and a receptacle extending through the body. The contact is disposed in the insulating housing and includes an inner portion extending into the receptacle and an outer portion disposed along an outer periphery of the insulating housing. The metal spring is disposed in the receptacle and includes a mid-section extending into and bias towards the receptacle.

20 Claims, 6 Drawing Sheets

(51) Int. Cl.

| | |
|---|---|
| ***H01R 13/703*** | (2006.01) |
| ***H01R 13/52*** | (2006.01) |
| ***H01R 13/627*** | (2006.01) |
| ***H01R 13/639*** | (2006.01) |
| ***H01R 13/6581*** | (2011.01) |
| ***H01R 13/70*** | (2006.01) |
| *H01R 12/72* | (2011.01) |
| *H01R 107/00* | (2006.01) |

(52) U.S. Cl.

CPC ..... *H01R 13/701* (2013.01); *H01R 13/7032* (2013.01); *H01R 13/7033* (2013.01); *H01R 12/722* (2013.01); *H01R 2107/00* (2013.01)

(56) References Cited

U.S. PATENT DOCUMENTS

| | | | | |
|---|---|---|---|---|
| 4,165,147 | A | 8/1979 | Buck | |
| 4,529,257 | A * | 7/1985 | Goodman | H01R 13/65802 174/359 |
| 4,684,190 | A * | 8/1987 | Clark | H01R 13/5219 439/277 |
| 4,702,543 | A * | 10/1987 | Hager | H01R 43/04 29/419.2 |
| 6,220,898 | B1 | 4/2001 | Wu | |
| 6,309,742 | B1 * | 10/2001 | Clupper | B32B 5/18 427/247 |
| 6,612,875 | B1 * | 9/2003 | Liao | H01R 13/2421 439/638 |
| 8,251,753 | B2 * | 8/2012 | Guo | H01R 12/57 439/668 |
| 2002/0025707 | A1 * | 2/2002 | Hida | G01R 24/46 439/188 |
| 2005/0027326 | A1 | 2/2005 | Ries et al. | |
| 2007/0123111 | A1 | 5/2007 | Chien et al. | |
| 2007/0218773 | A1 | 9/2007 | Uno et al. | |
| 2009/0023340 | A1 | 1/2009 | Zhu et al. | |
| 2010/0144195 | A1 | 6/2010 | Zhang | |
| 2010/0203767 | A1 | 8/2010 | Zhang | |

OTHER PUBLICATIONS

Machine Translation of CN2831493Y, dated Oct. 25, 2006, 6 pages.

* cited by examiner

ELECTRICAL CONNECTOR HAVING A SPRING WITH PARALLEL LEGS WITH BIASED MID-SECTIONS

CROSS-REFERENCE TO RELATED APPLICATIONS

This application is a continuation of PCT International Application No. PCT/EP2013/001442, filed May 15, 2013, which claims priority under 35 U.S.C. §119 to EP Patent Application No. 12003881.5, filed May 16, 2012.

FILED OF THE INVENTION

The present invention relates to an electrical connector and, in particular, to an electric SMD connector

BACKGROUND

CN 200520075293 U disclosed a known electrical connector having a spring formed of a bent metal rod of circular cross section. However, due to such a design, the spring of the known connector is sensitive for variations in the diameter of the plug. In other words, the spring force exerted on the plug for holding the same in place may vary and be insufficient dependent on the tolerance allowed for the plug and/or wear of the plug due to multiple plug-in and plug-out operations.

SUMMARY

Accordingly, an electrical connector is provided in view of the aforementioned issues and includes an insulating housing, a contact, and a metal spring. The insulating housing includes a body with a substantially planar lower wall and a receptacle extending through the body. The contact is disposed in the insulating housing and includes an inner portion extending into the receptacle and an outer portion disposed along an outer periphery of the insulating housing. The metal spring is disposed in the receptacle and includes a mid-section extending into and bias towards the receptacle.

BRIEF DESCRIPTION OF THE DRAWINGS

The present invention will now be described by referring to a specific embodiment in combination with the drawing. In the drawing.

DETAILED DESCRIPTION OF THE EMBODIMENT(S)

In the following, the present invention is described in detail based on an embodiment shown in the accompanying drawings.

Figure 1:
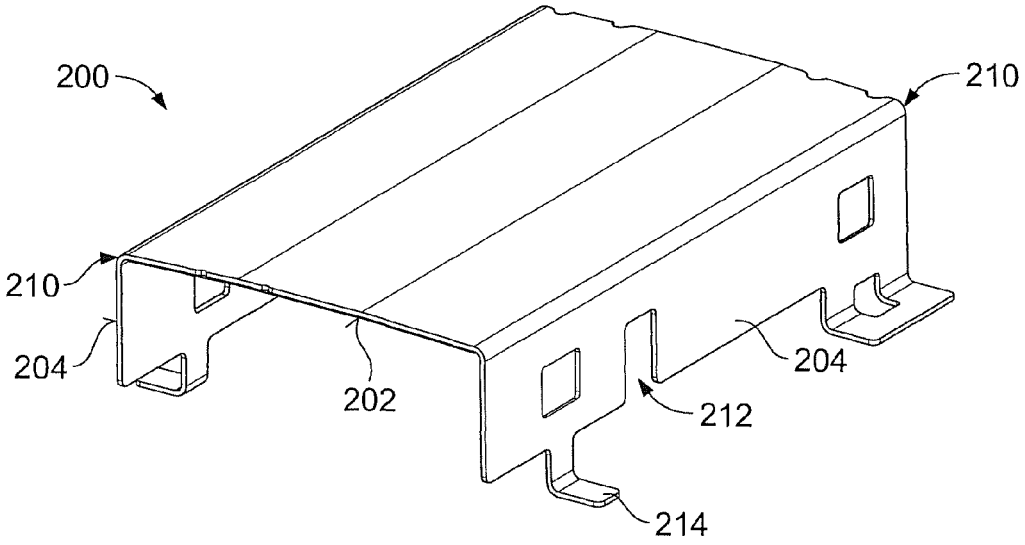
FIG. 1 is an exploded perspective view of a connector according to the invention.
Figure 1:
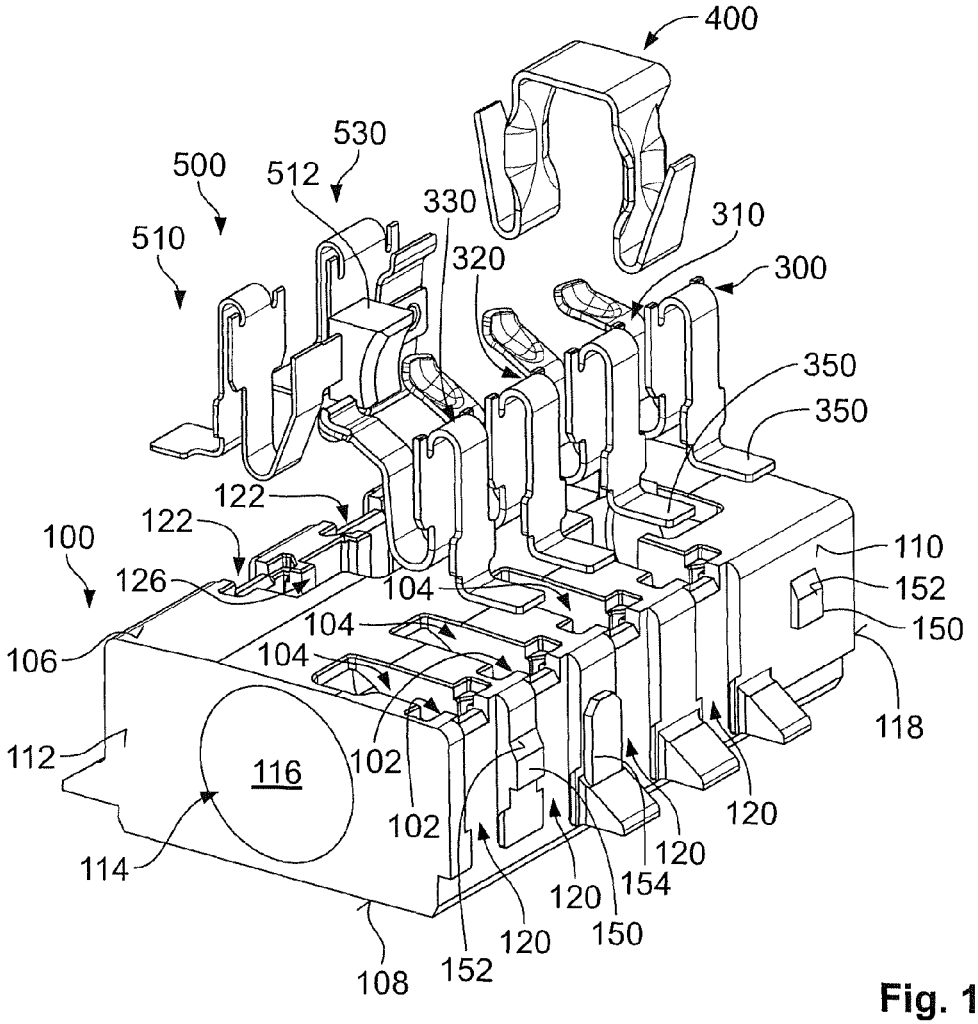

With reference to FIG. 1 the connector according to the invention is shown and includes a housing 100, a shell 200, plurality of contacts 300, 310, 320, 330, a spring 400, and a switch 500.

The housing 100 is made of a polymeric material by injection-molding and the shell 200 to be attached to the housing 100. The plurality of contacts 300, 310, 320, 330 are provide within the housing 100 and covered by the shell 200. The contacts to provide an electrical path between a plug (not shown) which may be introduced into the housing 100 and received therein in the plug-in state and the outer periphery of the housing 100. Further, the spring 400 is also provided in the housing 100 and used to secure the plug with the housing 100. Finally, a switch 500 is also provided housing 100.

The housing 100 defines four contact receiving spaces 102, each being assigned to receive one of the contacts 300, 310, 320, 330. Each contact receiving space 102 has a receiving opening 104 recessed in an upper wall 106 which is substantially planar and extends essentially parallel to a lower wall 108. The lower wall 108 is adapted to extend essentially parallel to a board of a printed circuit (not shown) on which the connector will be provided. Those upper and lower walls 106, 108 are connected by side walls 110 extending along the long side of the housing 100. A front face 112 defines a receptacle opening 114 for a longitudinal receptacle 116 extending in lengthwise direction of the housing 100, which on its other longitudinal end is closed by an opposing front face 118 of the housing 100 (see FIG. 3).

Figure 2:
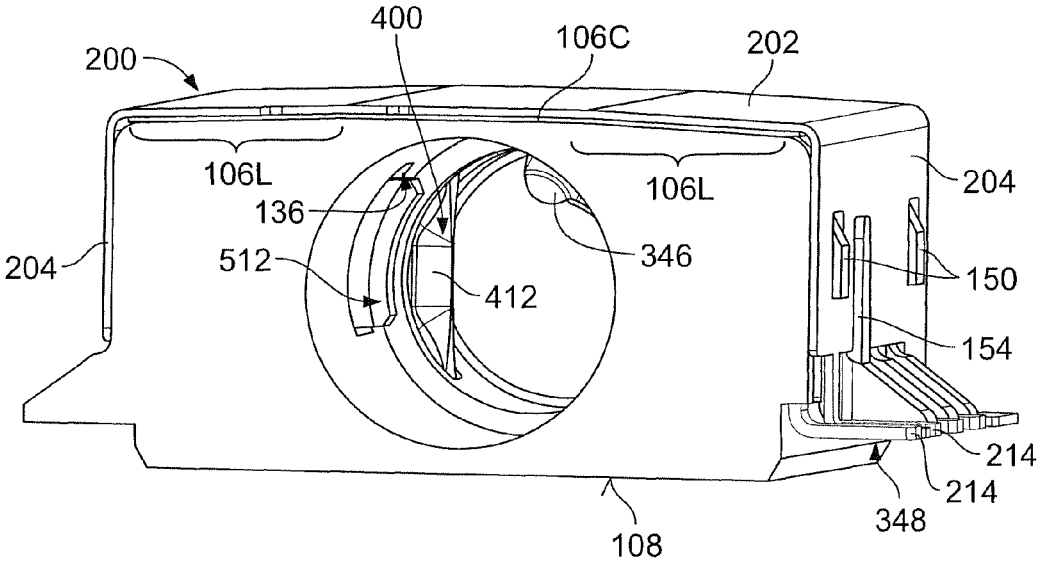
FIG. 2 is a perspective front view in of the connector according to the invention.
Figure 3:
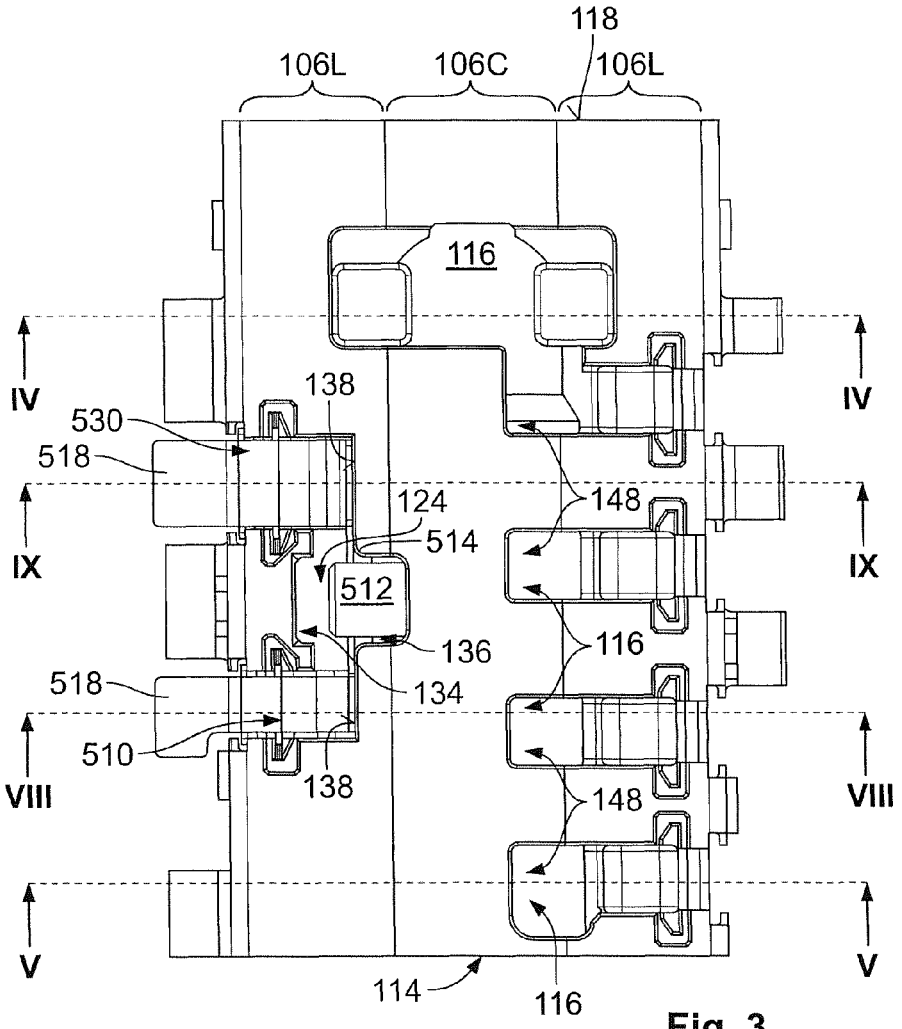
FIG. 3 is a top view of the connector according to the invention showing contacts and a spring removed from the housing.

As shown in FIGS. 2 and 3, the upper wall 106 includes a central portion 106C and two lateral portions 106L. In the shown embodiment, the lateral portions 106L are slightly bent downward, i.e. toward the side walls 110. The central portion 106C of the upper wall 106 extends parallel with the lower wall 108, while the lateral portions 106L are slightly inclined relative to the central portion 106C with an angle of 3°. The angle of inclination between the lateral portion 106L and the central portion 106C is usually selected to be between 1° and 15°, preferably between 2° and 10°.

As shown in FIG. 1, grooves 120 are disposed along one side wall 110 and correspond with the contacts 300, 310, 320, 330. Respective grooves 122 are provided on the opposite side wall 110 for contact sections of a movable electrical switch contact 510 and a mating electrical switch contact 530 of the switch 500. The housing 100 also includes a switch compartment 124 accessible from the upper wall 106 through a switch receiving opening 126 (see FIG. 3).

Figure 8:
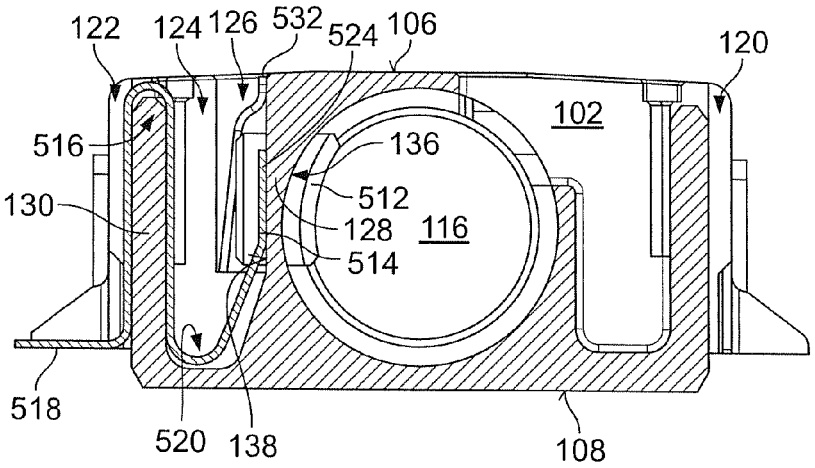
FIG. 8 is a sectional view of the connector of FIG. 3 taken along the line VIII-VIII.
Figure 9:
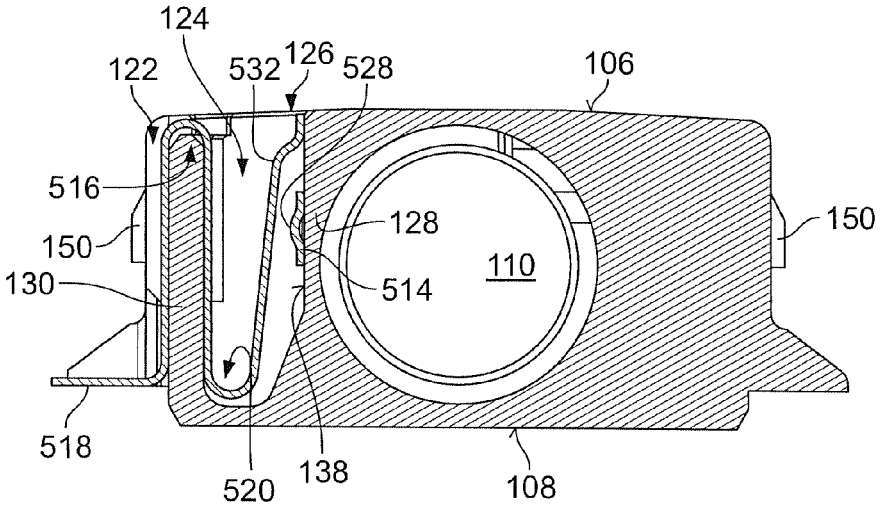
FIG. 9 is a sectional view of the connector of FIG. 3 taken along the line IX-IX.

The switch compartment 124 is separately portioned from the receptacle 116 by a wall 128 (see FIG. 8, 9). The other end of the switch compartment 124 as seen in the sectional views in accordance with FIGS. 8 and 9 is defined by a rim section 130 of the housing 100. A respective rim section 132 defines an outer wall of each contact receiving space 102 (see FIG. 5).

A stop 134 is provided between the two rim sections 130 of the switch compartment 124 and includes a recess adapted to receive an activator 512 of the movable electrical contact 310. The activator 512 is injection-molded around an arm 514 of the movable electrical switch contact 510 extending in the extension direction of the receptacle 116 (see FIG. 1, 7). The activator 512 is slidably held in a direction perpendicular to the extension direction of the receptacle 116 within an activator holding-slot 136, which tightly receives the activator 512. In other words, only a small gap exists on the circumference around the activator 512 and a recess in the wall 128 surrounding the holding-slot 136. The wall 128 separates the receptacle 116 from the switch compartment 124.

Figure 6:
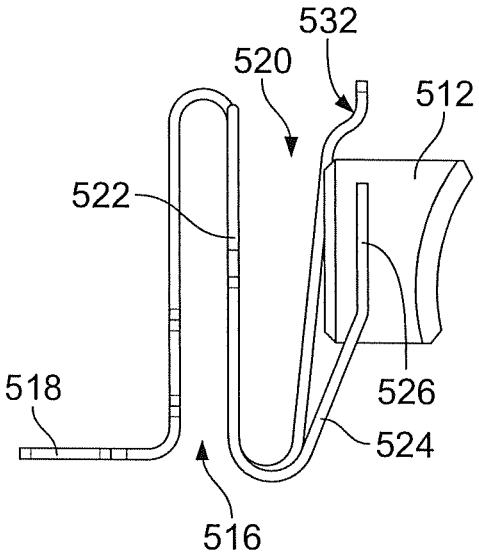
FIG. 6 is a side view of a switch of the connector according to the invention.
Figure 7:
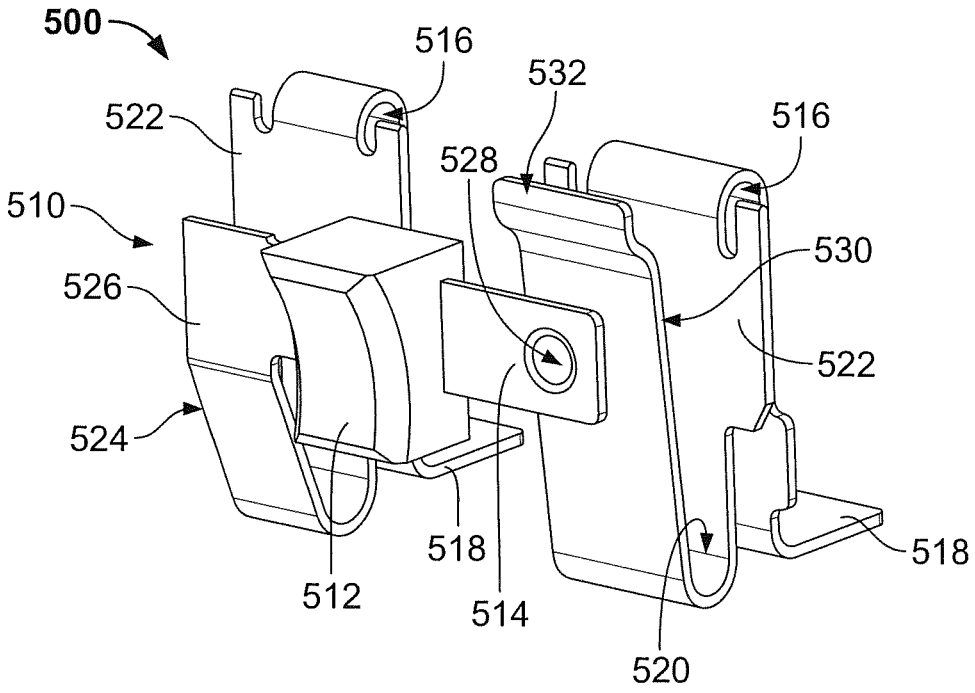
FIG. 7 is a perspective view of the switch according to FIG. 6.

Now with reference to FIGS. 6 and 7, the switch 500 will be discussed.

In the shown embodiment, the switch 500 is includes two bent pieces of sheet metal. One of those sheet metal pieces is bent to form the movable electrical switch contact 510 while the other sheet metal piece is bent to form the mating electrical switch contact 530. The mating electrical switch contact 530 and the movable electrical switch contact 510 have a partially identical design which will be described hereinafter by referring to the movable electrical switch contact 510, only. The sheet metal material is bent to define a U-shaped fastening section 516 adapted to encompass and thereby fix against the rim section 132 (see FIG. 8, 9). The outer end of the U-shaped fastening section 516 is bent to define a contact lug 518 extending essentially coincident with the surface of the lower wall 108. The outer part of the U-shaped fastening section 516 is received within the groove 122 of the housing 100. The sheet metal piece is bent to essentially embody a double U-shaped configuration with the U-shaped fastening section 516 on the outer side and a counter bent U-shaped contact section 520 on the inner side, both U-shaped sections 516, 520 having one leg 522 in common. An inner leg 524 of the U-shaped contact section 520 has an end section 526 which is bent to lie flush against a reference surface 138 defined by the wall 128 (see FIGS. 8, 9). From this end section 526 the arm 514 extends parallel to the extension direction of the receptacle 116, which overlaps with an inner leg 532 of the mating electrical switch contact 530 (see FIG. 9). At this overlap the free end of the arm 514 is cold worked to define a convex projection 528 that defines the contacting surface cooperating with the inner leg 532. Further, the arm 514 abuts against the reference surface 138.

As evident from FIG. 9, the free end of the inner leg 532 of the mating electrical switch contact 530 is likewise bent to abut against the reference surface 138. Thus, both switch contacts 510, 530 of the switch 500 are pushed against the reference surface 138 if the activator 512 projects into the receptacle 116 in absence of a plug received therein. Accordingly, the switch contacts 510, 530 are protected from being damaged by misuse and overstress. If a plug is introduced into the receptacle 116, the activator 512 slides along the activator holding-slot 136 until the activator 512 abuts against the stop 134. In the course of this movement, electrical contact is made between the projection 528 and the inner leg 532 and thus, between the movable electric contact 510 and the mating electrical switch contact 530. Again, and due to the assignment of the stop 134 to the activator 512, damage by excessive bending of the movable electrical switch contact 510 and/or the mating electrical switch contact 530 is avoided.

Further, the switch 500 is adapted to minimize the space for mounting the same. The only open area to the receptale 116 is the holding-slot 136 through which the activator 512 projects. The rest of the switch 500 is arranged behind the wall 128 to eliminate possible contamination from the usage of the embodiment, e.g. by multiple introductions of the plug into the receptacle 116. Thanks to the reference surface 138, the movable electrical switch contact 510 and the mating electrical switch contact 530, namely, the U-shaped contact sections 520 of both switch contacts 510, 530, are assembled within the switch compartment in the housing 100 in a predetermined preloaded state, which gradually reduces assembly tolerances.

Further, since the switch 500 and the contacts 300, 310, 320, 330 are introduced from the same side, i.e. through the upper wall 106, no rotation of the housing 100 is required when assembling the shown embodiment, which reduces production costs.

As shown hereinafter, this advantage is further enhanced as the spring 400 which is also introduced into the housing 100 through the upper wall 106.

Figure 11:
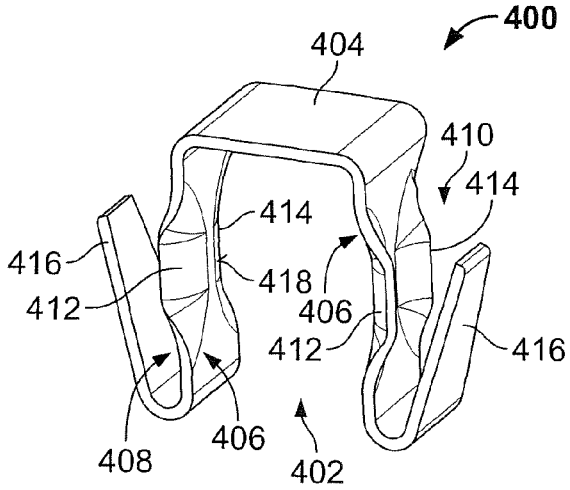
FIG. 11 is a perspective elevated front view of a spring of the connector according to the invention.

In the following, the spring 400 will be described, in particular by referring to FIG. 11. The spring 400 includes a U-shaped section 402 with a base 404 from which two identical spring legs 406 extend. Those spring legs 406 extend essentially parallel to each other and normal to the flat base 404 of the U-shaped section 402. The spring 400 is made of a sheet metal which is cut and bent to achieve the configuration depicted in FIG. 11. In particular by bending of the sheet metal in a mid-section of the spring legs 406 a chamfered lead-in configuration 412 is provided along a forward end 408 thereof. A respective chamfered lead-out configuration 414 is also provided at the rearward end 410 thereof. The chamfered lead-in and lead-out configurations 412, 414 facilitate passing of a forward tip of the plug when inserted into the receptacle 116 and wear is reduced. Since the spring 400 is made of a sheet metal having a considerably larger width, i.e. extension in extension direction of the plug, than thickness, i.e. extension in radial direction relative to the receptacle 116, a sufficient spring force can be exerted on the plug to hold the same in place within the housing 100 while at the same time providing a long stroke to cope with plug tolerances.

Figure 4:
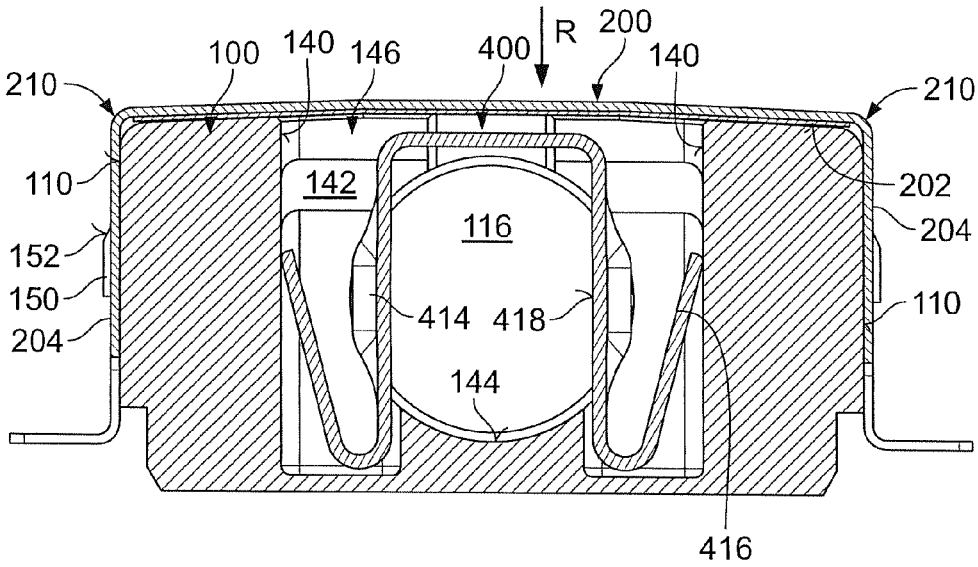
FIG. 4 is a sectional view of the connector of FIG. 3 taken along the line IV-IV.

Securing legs 416 are provided along the free end of the spring legs 406 and are bent upwardly from a lower end of the spring legs 406 toward the base 404. As shown, the spring leg 406 define a V-shaped configuration. As shown in FIG. 4, the securing legs 416 have an essentially straight extension and abut against an inner wall 140 of the housing 100 defining a spring compartment 142 with a sharp angle of approximately 20° to 40°. Thus, the free end of the securing legs 416 are adapted to claw against the inner wall 140, thereby fixing the spring 400 within the housing 100 by positive locking As shown in FIG. 4, the U-shaped section 402 of the spring 400 surrounds the plug along three sides of a rectangle. The lowermost delimination of the plug is provided by a concave base surface 144 defined by the housing 100 (see FIG. 4). Supported by this base surface 144, a plug with a circular cross section will have its maximum extension in the width direction of the housing 100, i.e. in a direction parallel to the extension of the lower wall 108 at the level of the chamfered lead-in and lead-out configurations 412, 414. The plug may have a groove or the like recessed on the outer circumference of the plug, which cooperates with a remaining abutment face 418 between the lead-in and the lead-out configurations 412; 414. A mid-section of the spring legs 406 corresponds with the position of the plug in which the same has the maximum diameter in the width direction of the housing 100 (see FIG. 4). For this, the extension of the spring legs 406 in height direction is adapted to cooperate with the ground of the spring compartment 142 that is defined by the housing 100.

The spring 400 is inserted into the housing 100 through a spring receiving opening 146 (see FIG. 4).

Figure 5:
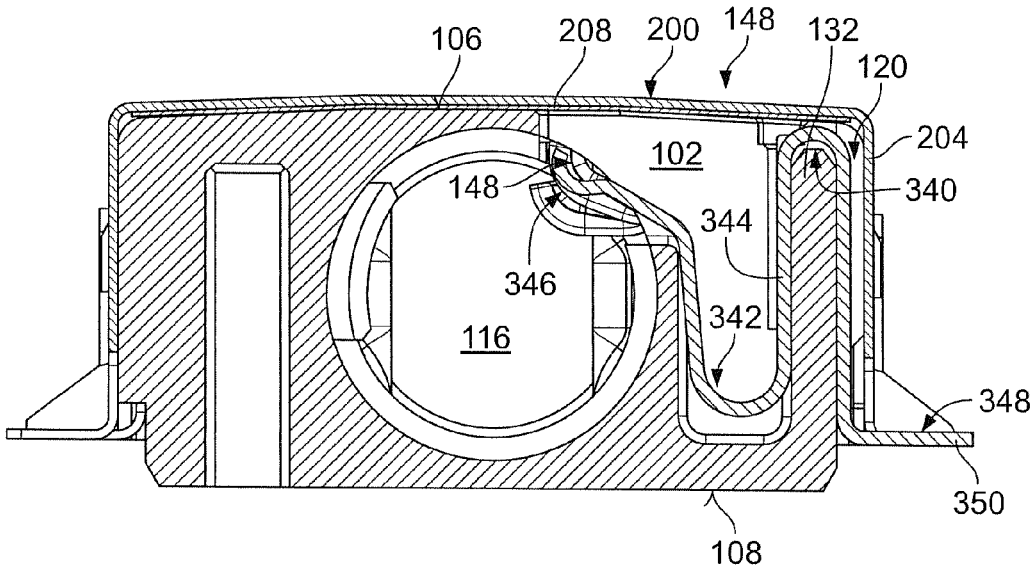
FIG. 5 is a sectional view of the connector of FIG. 3 taken along the line V-V

Now with reference to the FIG. 5, the contacts 300, 310, 320, 330 will be described. In the shown embodiment, each contact 300, 310, 320, 330 includes a U-shaped fastening section 340, which cooperates with the associated rim section 132 of the associated contact receiving space 102 (see FIG.

5). By this, the contacts 300, 310, 320 and 330 are each secured to the housing 100. The contact receiving space 102 is adapted to receive a U-shaped bent section 342. The U-shaped bent section 342 has an inner leg 344 of the U-shaped fastening section 340 in common with said U-shaped fastening section 340 (see FIG. 5). Each contact receiving space 102 has a contact opening 148 recessed within concave walls surrounding the receptacle 116 and defined by the housing 100. An inner portion 346 of the contact 300, 310, 320, 330 protrudes through each contact opening 148 and into the receptacle 116 to cooperate with a mating contact provided by the plug when the same is received within the receptacle 160 and secured by the spring 400. Thus, each contact 300, 310, 320, 330 provides a conductive path between the associated contact element of the plug and an outer portion 348 exposed on the outer periphery of the housing 100 and defining contact lugs 350 (see FIG. 5), which contact lugs 350 will be fixed to a printed circuit board.

Figure 10:
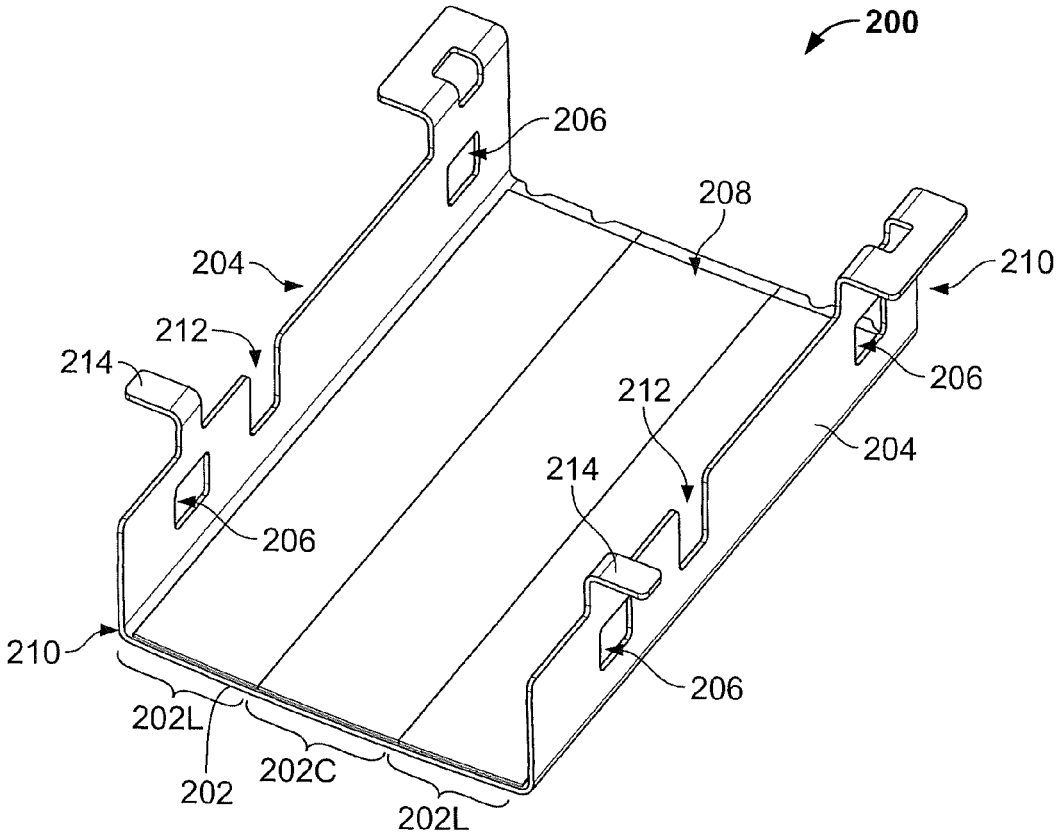
FIG. 10 is a perspective view of a shield of the connector according to the invention.

Next, with reference to FIG. 10, the shell 200 will be discussed. As shown in FIGS. 1 and 10, the shell 200 is U-shaped to define a sealing wall 202, which is designed to extend co-planar to the surface or surface sections of the planar upper wall 106. In accordance with the constitution of the housing 100, the shell 200 defines a sealing wall 202 with a central portion 202C and two lateral portions 202L extending in lengthwise direction of the shell 200. When not mounted with the housing 100, all portions 202 C, L extend essentially parallel with each other. There may be provided a bending line between the central portion 202C and the neighboring lateral portions 202L to facilitate bending at a predetermined position, i.e. along a predetermined line. This line is identified in FIG. 10.

The shell 200 furthermore defines two lateral side walls 204, which encompass opposing side walls 110 of the housing 100. Respective side walls 110 of the housing 100 are projected by notches 150, which are arranged to cooperate with notch openings 206 recessed within the lateral side walls 204. The notches 150 have an inclined sliding surface 152 against which the free end of the lateral side walls 204 will abut and slide, thereby bending the lateral side walls 204 outwardly to finally effect a snapping movement in which the notches 150 snap into the associated notch openings 206 to thereby secure the shell 200 against the housing 100. A sealing pad 208 is provided between the upper wall 106 and the inner surface being adjacent to the upper wall 106 when the shell 200 is mounted to the housing 100. The sealing pad 208 is attached to the shell 200. The sealing pad 208 has at least one compressible layer, which compressible layer may be a foam layer, which is covered by a further layer like a thin flexible polymer sheet or the like. According to an embodiment of the invention, the sealing pad 208 is a multi-layer foam, in which at least one layer is an adhesive suitable to glue the adhesive foam against the shell 200 or the housing 100 and at least one compressible material adhered to the inner side of the adhesive by an adhesive bonding layer, which compressible material may be a natural or synthetic rubber and will have a thickness of between 0.1 to 0.4 mm, preferably of between 0.2 to 0.35 mm. The outer layer of the multi-layer foam is—on a regular basis—provided by a polymeric film covering the foam material. The polymeric film may be made of polyimide protecting the sealing pad 208 from higher temperatures during soldering.

As shown in FIG. 2, the notches 150 are adapted to cooperate with the notch-openings 206 of the shell 200. For this, however, the shell 200 has to assume a bent shape in which the shield, which originally has a U-shaped form with an essentially straight sealing wall 202 will be deformed. Accordingly, the lateral portions 202L will be bent downwardly to assume a shape in essentially parallel with the lateral portions 106L of the upper wall 106 compressing there between the sealing pad 208. As a cause of this elastic deformation of the sealing wall 202 the sealing pad 208 is pressed against the housing 100 thereby enhancing sealing of the outer side of the housing 100. Further, and as a reaction of the elastic deformation of the sealing wall 202 made of a sheet material, the sealing pad 208 will be pressed into the slight recesses provided near a lateral end of the housing 100 where the contacts 300, 310, 320, 330 or contacts of the switch 500 pass the apex of the rim sections 130 or 132. There, the semi-circular radius of each U-shaped fastening section 340 or 516 will not necessarily be flush with the upper wall 106. In other words, the compressible sealing pad 208 will be squeezed into recesses provided on the upper wall to prevent water having entered through the longitudinal receptacle 116 from leaking to the outside of the housing.

As further shown FIGS. 1 and 10, the shell 200 includes two guiding slots 212 which guiding slots 212 along its lateral side walls 204 to cooperate with a projection 154 projecting the side wall 110 of the housing 100 and guide the shell 200 during mounting with housing 100 and to avoid misplacement of the shell 200 relative to the housing 100. Further, and projecting the forward notch opening 206 of the shell 200, contact lugs 214 are formed by bending the sheet metal defining the shell 200 outwardly, whereby contact lugs 214 are to connect the shell 200 to mass for grounding the shell 200.

The afore-mentioned description has been made by referring to an electrical connector. This connector may be provided in various devices, in particular, mobile electronic devices like cellular phones, tablet PCs or music players. They may likewise be provided in laptops or stationary devices like desktop computers, television or the like. Each of the afore-mentioned aspects has to be regarded as independently realizing the invention. For the second and the third aspect of the present invention, the spring is not a mandatory feature. Thus, the spring may be omitted and the plug may be secured to the connector by other means.

Although exemplary embodiments have been shown and described, it would be appreciated by those skilled in the art that various changes or modifications may be made in these embodiments without departing from the principles and spirit of the disclosure, the scope of which is defined in the claims and their equivalents.

What is claimed is:

1. An electrical connector, comprising:

an insulating housing having a body with a substantially planar lower wall and a receptacle extending through the body;

a contact disposed in the insulating housing and having an inner portion extending into the receptacle and an outer portion disposed along an outer periphery of the insulating housing; and a metal spring disposed in the receptacle and having a pair of parallel spring legs, a mid-section of each of the pair of parallel spring legs extending into and biased towards the receptacle.

2. The electrical connector according to claim 1, wherein the spring includes a U-shaped section with a base.

3. The electrical connector according to claim 2, wherein the U-shaped section surrounds the receptacle.

4. The electrical connector according to claim 3, wherein the mid-section defines a chamfered lead-in configuration.

5. The electrical connector according to claim 2, further comprising a pair of securing legs extending from free ends of the pair of parallel spring legs.

6. The electrical connector according to claim 5, wherein the pair of securing legs defines a V-shaped configuration.

7. The electrical connector according to claim 2, wherein the insulating housing includes a substantially planar upper wall extending substantially parallel to the lower wall and defining a metal contact receiving opening.

8. The electrical connector according to claim 7, further comprising a shell attached to the insulating housing and having a sealing pad disposed between the shell and the upper wall.

9. The electrical connector according to claim 8, wherein the shell is U-shaped and includes a sealing wall extending substantially parallel to the upper wall and lateral side walls encompassing opposing side walls of the insulating housing.

10. The electrical connector according to claim 9, wherein the sealing pad includes a multi-layer foam.

11. The electrical connector according to claim 10, wherein the multi-layer foam includes an adhesive layer and a compressible material layer.

12. The electrical connector according to claim 11, wherein the sealing pad includes an outer polyimide layer.

13. The electrical connector according to claim 2, further comprising a switch having an activator movable within the receptacle.

14. The electrical connector according to claim 13, wherein the switch further includes a movable electrical switch contact disposed in the insulating housing and cooperating with the activator.

15. The electrical connector according to claim 14, wherein the switch further includes another electrical switch contact connectable with the movable electrical switch contact during movement of the activator.

16. The electrical connector according to claim 15, wherein the movable electrical switch contact and the other electrical switch contact are arranged behind a wall defining the receptacle.

17. The electrical connector according to claim 16, further comprising a stop disposed in the insulating housing limiting movement of the activator.

18. The electrical connector according to claim 14, wherein the activator is an injection-molded article surrounding an arm of the movable electrical switch contact.

19. The electrical connector according to claim 5, wherein each securing leg abuts an inner wall of the housing.

20. The electrical connector according to claim 1, wherein the mid-sections of each of the pair of parallel spring legs are the only portions of the metal spring extending into the receptacle.

* * * * *